United States Patent [19]

Johnson et al.

[11] Patent Number: 4,923,490

[45] Date of Patent: May 8, 1990

[54] NOVEL GRINDING WHEELS UTILIZING POLYCRYSTALLINE DIAMOND OR CUBIC BORON NITRIDE GRIT

[75] Inventors: Neil R. Johnson, Columbus; Harold P. Bovenkerk, Worthington, both of Ohio

[73] Assignee: General Electric Company, Worthington, Ohio

[21] Appl. No.: 286,450

[22] Filed: Dec. 16, 1988

[51] Int. Cl.[5] ..... C09K 3/14

[52] U.S. Cl. ..... 51/298; 51/295; 51/309

[58] Field of Search ..... 51/295, 298, 309

[56] References Cited

U.S. PATENT DOCUMENTS 4,224,380 9/1980 Bovenkerk et al. ..... 51/309
4,225,322 9/1980 Knemeyer ..... 51/295
4,440,573 4/1984 Ishizuka ..... 51/309
4,457,765 7/1984 Wilson ..... 51/309
4,798,026 1/1989 Cerceau ..... 51/309

FOREIGN PATENT DOCUMENTS 2568810 2/1986 France .

*Primary Examiner*—Paul Lieberman
*Assistant Examiner*—Willie J. Thompson
*Attorney, Agent, or Firm*—Gary L. Loser

[57] ABSTRACT

The invention provides grinding tools comprising thermally stable polycrystalline diamond or cubic boron nitride abrasive particles and single crystal diamond or cubic boron nitride abrasive particles attached to a support means via a bonding matrix such as a sintered or electrodeposited metal or alloy matrix, a resinous matrix, or a vitreous matrix.

11 Claims, No Drawings

NOVEL GRINDING WHEELS UTILIZING POLYCRYSTALLINE DIAMOND OR CUBIC BORON NITRIDE GRIT

BACKGROUND OF THE INVENTION

Reference is made to the co-pending patent application of L. L. White, et al., entitled "Novel Drill Bits Utilizing Polycrystalline Diamond Grit", U.S. Pat. Application Ser. No. 262,910, filed Oct. 25, 1988, now allowed and M. E. Deakins, et al., entitled "Novel Sawblade Segments Utilizing Polycrystalline Diamond Grit," U.S. Pat. Application Ser. No. 262,405, filed Oct. 25, 1988.

The present invention generally relates to improved grinding tools and, more particularly, to grinding wheels containing polycrystalline diamond or cubic boron nitride (CBN) grit (i.e., superabrasives) as the abrasive material.

It is well known in the art to adhere diamond and cubic boron nitride crystals to a support base useful for grinding operations via matrices formed of sintered metals, resins, or vitreous materials, or by electroplating the support base and thereby encapsulating the abrasive grit in the process. Basically, the procedure for adhering superabrasive particles to a support base by sintered metals or resins are similar. The superabrasive particles are intimately mixed with powdered metals or resin powders. The combined powder and superabrasive particles are compressed into a briquet over the support base and the powdered mixture is then heated in a furnace or a heated mold at a temperature sufficient to fuse the resin or to sinter the metal powder into a rigid mass. Either of these matrices form only a mechanical bond with the support base.

Vitreous materials are generally glass-like and powders thereof are mixed with the superabrasive particles and are pressed in a usable form over the support base and then heated, causing the glass to fuse to the support base and the superabrasive particles.

In the electroplating procedure, superabrasive particles are held close to the support base and are immersed in one of several standard plating baths. The support base acts as the anode and a metal such as nickel or copper acts as the cathode. By the electroplating technique, a mixture of plated metal encapsulates the superabrasive particles and at the same time adheres to the support base.

Typically, the diamond or CBN particles are single crystals, however, U.S. Pat. No. 4,776,861, assigned to the same assignee as the present invention, teaches that diamond or CBN polycrystalline abrasive grit useful in tools for grinding can be made by size reducing and leaching non-superabrasive material from a larger polycrystalline compact.

Such polycrystalline abrasive grit is similar in many respects to the thermally stable porous compacts described by Bovenkerk, et al., in U.S. Pat. No. 4,224,380, also assigned to the same assignee as the present invention. In addition, Gigl, et al., teach in U.S. Pat. No. 4,738,689, assigned to the same assignee as the present invention, that enhanced oxidation resistance can be imparted to porous, thermally stable products by coating the exterior surfaces thereof with a metal or the like. All of the foregoing patents are incorporated by reference into the present disclosure.

SUMMARY OF THE INVENTION

It is an object of the present invention to provide grinding wheels having a longer tool life.

It is another object of the present invention to provide grinding wheels having higher removal rates.

It is still another object of the present invention to provide grinding wheels having improved free cutting properties.

In accordance with the foregoing objects, there is provided an improved grinding tool comprising thermally stable polycrystalline diamond or CBN grit of from about 1 to 2000 microns dispersed in a bond matrix. Preferably, the superabrasive grit is from about 100 to about 1500 microns, and more preferably is from about 500 to 1500 microns (i.e., 35 mesh to 14 mesh). The bond matrix may be any metal, resin, vitreous or electrodeposited matrix conventional in the art, and may include or be free of filler material. In a particularly preferred embodiment, a mixture of single crystal and polycrystalline superabrasive particles are employed.

DESCRIPTION OF THE INVENTION

Grinding tools (e.g., wheels, discs, and belts) of the present invention generally comprise an effective amount of thermally stable polycrystalline diamond or CBN dispersed in a sintered or electrodeposited metal matrix, a resin matrix, or a vitreous matrix. The thermally stable polycrystalline superabrasive particles can vary in size over a broad range, for example, from 1 to 2000 microns, but preferably range from about 100 to about 1500 microns, and most preferably range from about 500 to about 1500 microns.

Especially preferred thermally stable polycrystalline diamond and CBN particles are of the type described in U.S. Pat. No. 4,224, 380 to Bovenkerk, et al. Briefly, such polycrystalline superabrasive particles comprises (i) between about 70 volume percent and about 95 volume percent of self-bonded diamond or CBN particles, (ii) a metallic phase infiltrated substantially uniformly throughout said particles, said phase comprising between about 0.05% and 3% by volume of a catalytic metal or alloy, and (iii) a network of interconnected, empty pores dispersed throughout said diamond or CBN particles.

Alternatively, such network of interconnected pores can be infiltrated with a material having co-efficient of thermal expansion about equal to that of diamond, for example, silicon or silicon carbide.

The present invention preferably employs metal coated polycrystalline diamond, for example, as described in U.S. Pat. No. 4,738,689. The use of such a coating provides better retention in the bond matrix and protection against thermal damage in oxidizing environments such as may be experienced with high temperature tool fabrication techniques. The preferred metal coatings are selected from the group consisting of titanium, zirconium, chromium, molybdenum, tungsten, niobium, tantalum and vanadium in elemental, alloyed, or compound form with any of the foregoing or other metals.

The aspect ratio of the polycrystalline particles can vary over a wide range, and generally is from about 4 to 1 to about 1 to 1. For most uses, an aspect ratio of less than 2 to 1, preferably less than 1.5 to 1, will be desired. By the term "aspect ratio" is meant the ratio of the longest dimension of the particle to the shortest dimension of the same particle.

Thermally stable superabrasive particles are utilized in the manufacture of grinding tools in an amount ranging from as little as 1 volume percent to as much as 50 volume percent or more. The concentration will, of course, depend upon the particular application and whether the polycrystalline superabrasive grit is to be used in combination with conventional single crystal superabrasive particles.

It is contemplated that in many applications, both single crystal and polycrystalline superabrasive particles will be employed so as to overcome the disadvantageous properties of each. That is, polycrystalline particles wear by microfracture, which can lead to wear flats and little protrusion of the particles, thereby increasing power consumption and causing workpiece burning or even wheel failure. Single crystals on the other hand are more apt to wear by gross fracture and pull out which causes high wheel wear rates. A combination of single and polycrystals can balance the wear mechanisms and provide the opportunity for slower wheel wear and higher rate grinding. This applies to all bond systems, vitreous resin, metal sintered and plated.

When such a combination of superabrasive grit is employed, the concentration of polycrystalline grit preferably ranges from about 5 to about 30 volume percent and the concentration of single crystal grit preferably ranges from about 30 to about 5 volume percent. Those skilled in the art can ascertain optimum ratio of single crystal superabrasive to polycrystalline superabrasive without undue experimentation. Of course, single crystal diamond grit can be either natural bort diamond or manufactured diamond.

A grinding tool of the present invention comprises the desired size of thermally stable polycrystalline abrasive grit, preferably in combination with single crystal abrasive grit, in a suitable bonding medium. Tools having diamond or cubic boron nitride abrasive particles held in place by a vitreous, metallic, plated or resin bond matrix are well known in the art, as are various methods of making them.

Examples of suitable metal and plated bond matrices are disclosed in the following U.S. Pat. Nos.:

U.S. Pat. No. 2,072,051—alloys of copper such as copper/nickel, copper/aluminum, copper/tin and copper/manganese.

U.S. Pat. No. 2,077,345—sintered aluminum and silicon, the silicon and aluminum not being competely alloyed.

U.S. Pat. No. 2,137,200—sintered alloys of aluminum and an intermetallic element, such as aluminum/nickel, aluminum/iron, aluminum/magnesium and aluminum/-cobalt.

U.S. Pat. No. 2,137,201—silver or a silver based alloy containing a hardening agent such as copper, zinc or cadmium.

U.S. Pat. No. 2,137,329—copper/tin alloys containing up to 15% tin.

U.S. Pat. No. 2,216,908—carbides such as tungsten carbide and molybdenum carbide, along or in combination with tantalum carbide, titanium carbide, vanadium carbide or chromium carbide.

U.S. Pat. No. 2,238,351—copper/iron/tin and copper/iron/tin/nickel matrices.

U.S. Pat. No. 2,360,798—electroplating of metals such as nickel, chromium, cobalt, palladium, rhodium and alloys thereof.

U.S. Pat. No. 2,737,454—sintered bronze matrix of, on a weight percent, 87Cu 13Sn to 95Cu 5Sn, plus from 3 to 7 weight percent iron oxide.

U.S. Pat. No. 3,663,191—vapor phase deposition of chromium, cobalt, iron, molybdenum, nickel, tantalum, titanium, tungsten, vanadium, and other metals capable of forming carbides.

U.S. Pat. No. 4,378,233—bond matrix of aluminum, zinc, copper and tin, with up to 50% of a dry film lubricant filler.

U.S. Pat. No. 4,547,998—electro-deposited matrix having pores.

Examples of suitable resin and vitreous bond matrices are disclosed in the following U.S. Pat. Nos.:

U.S. Pat. No. 2,097,803—phenolic resin matrix, e.g. reaction product of phenol and formaldehyde.

U.S. Pat. No. 2,216,728—vitreous matrix formed from powdered glass and carbonaceous material.

U.S. Pat. No. 3,518,068—metal coated abrasive particles in a phenolic resin matrix.

U.S. Pat. No. 3,528,788—metal coated abrasive particles in a phenolic, epoxy, polyimide, alkyd, polyester, silicone or polyamidimide resin matrix.

U.S. Pat. No. 3,664,819—phenolic, polyester, epoxy, polybenzimidazole, polyimide or polysulfide resin matrix containing filler selected from the group consisting of silicon carbide, alumina, zirconia, magnesia, silica, asbestos, copper, nickel, cobalt, iron and graphite.

U.S. Pat. No. 3,779,727—resin matrix containing silver, silver coated copper, or copper and a particular dry film lubricant filler.

U.S. Pat. No. 4,042,347—bond matrix consisting of an interlocked metal phase and resin phase.

Grinding tools contemplated by the present invention include grinding wheels, discs and belts of all shapes and sizes, for example, as shown in U.S. Pat. Nos. 2,072,051 to Van der Pyl; 2,137,201 to Boyer; 2,216,908 to DeBats; 2,942,387 to Lindblad; 3,372,010 to Parsons; 3,383,807 to miller; 3,779,727 and 4,402,346 to Sioui; and 4,246,004 to Busch, et al.

Many other variations and modifications may be made by those of ordinary skill in the art without departing from the spirit and scope of the invention.

We claim:

1. A grinding tool, comprising from about 5 to 30 volume percent thermally stable polycrystalline diamond or polycrystalline cubic boron nitride abrasive particles and from about 5 to 30 volume percent single crystal diamond or single crystal cubic boron nitride abrasive particles attached to a support via a bond matrix, where in the balance being bonding matrix.

2. A tool as set forth in claim 1, wherein the bond matrix is selected from the group consisting of a sintered metal or alloy matrix, an electro-deposited metal or alloy matrix, a resin matrix or a vitreous matrix.

3. A tool as set forth in claim 1, wherein the thermally stable polycrystalline diamond or cubic boron nitride abrasive particles are from 1 to 2000 microns.

4. A tool as set forth in claim 2, wherein the thermally stable polycrystalline diamond or cubic boron nitride abrasive particles are from about 100 to about 1500 microns.

5. A tool as set forth in claim 2, wherein the thermally stable polycrystalline diamond or cubic boron nitride abrasive particles are from about 500 to about 1500 microns.

6. A tool as set forth in claim 5, wherein the thermally stable polycrystalline abrasive particles are diamonds and the network of interconnected empty pores has been infiltrated with a material having a co-efficient of thermal expansion about equal to that of diamond.

7. A tool as set forth in claim 1, wherein the abrasive particles are coated.

8. A tool as set forth in claim 7, wherein said coating is a metal.

9. A tool as set forth in claim 1, wherein the aspect ratio of the thermally stable polycrystalline diamond or cubic boron nitride abrasive particles is from about 4 to 1 to about 1 to 1.

10. A tool as set forth in claim 9, wherein the aspect ratio of the thermally stable polycrystalline diamond or cubic boron nitride abrasive particles is less than about 2 to 1.

11. A grinding tool, consisting essentially of from about 5 to 30 volume percent thermally stable polycrystalline diamond or polycrystalline cubic boron nitride abrasive particles and from about 5 to 30 volume percent single crystal diamond or single crystal cubic boron nitride abrasive particles attached to a support via a bond matrix wherein the balance being bonding matrix.

* * * * *